US006250479B1

(12) United States Patent
Satake et al.

(10) Patent No.: US 6,250,479 B1
(45) Date of Patent: Jun. 26, 2001

(54) ROTATIONALLY OSCILLATING SEPARATOR WITH ECCENTRIC SHAFT MOUNTING PORTIONS

(75) Inventors: Satoru Satake, Ota-Ku; Makoto Tomabechi, Chiyoda-Ku; Hideaki Masukane, Chiyoda-Ku; Akira Fukuhara, Chiyoda-Ku; Kiminori Kono, Chiyoda-Ku; Kazutaka Bajyo, Chiyoda-Ku; Chozaburo Ikuta, Chiyoda-Ku, all of (JP)

(73) Assignee: Satake Corporation, Tokyo (JP)

( * ) Notice: Subject to any disclaimer, the term of this patent is extended or adjusted under 35 U.S.C. 154(b) by 0 days.

(21) Appl. No.: 09/638,854

(22) Filed: Aug. 15, 2000

(51) Int. Cl.[7] ..... B07C 9/00; B03B 5/20; B07B 13/00

(52) U.S. Cl. ..... 209/691; 209/481; 209/696; 209/503

(58) Field of Search ..... 209/504, 481, 209/480, 479, 691, 696, 695, 503

(56) References Cited

U.S. PATENT DOCUMENTS

| | | | | |
|---|---|---|---|---|
| 285,098 | * | 9/1883 | Anderson | 209/446 |
| 632,075 | * | 8/1899 | Waters | 209/441 |
| 666,603 | * | 1/1901 | Cramer | 209/438 |
| 676,419 | * | 6/1901 | Carter | 209/14 |
| 829,493 | * | 8/1906 | Thurston | 209/445 |
| 897,489 | * | 9/1908 | Frinz | 209/691 |
| 1,269,760 | * | 6/1918 | Turner | 209/436 |
| 2,822,090 | * | 2/1958 | Johnston | 209/481 |
| 4,077,873 | * | 3/1978 | McKibben | 209/332 |
| 4,269,703 | * | 5/1981 | Bruderlein | 209/243 |

FOREIGN PATENT DOCUMENTS

| | | |
|---|---|---|
| 11-226509 | 8/1999 | (JP) . |
| 11-300285 | 11/1999 | (JP) . |

* cited by examiner

*Primary Examiner*—Donald P. Walsh
*Assistant Examiner*—Daniel K Schlak
(74) *Attorney, Agent, or Firm*—Pillsbury Winthrop LLP

(57) ABSTRACT

A rotationally oscillating separator for separating mixed rice into unhulled rice and unpolished rice after the rice have passed through a rice huller to remove the hulls from rice. The separator comprises a vertical rotating shaft supported for rotation and having an axis, means for rotatively driving the rotating shaft, said rotating shaft including eccentric sections offset from the axis of the rotating shaft, separating vessels rotatably mounted on the eccentric sections and having a plurality of segmental separating plates disposed in a cone-shaped configuration within the separating vessels, retaining means on the separating vessels for preventing them from freely rotating, each of the eccentric sections having its axis, an upward extension of which is at a slight angle to the axis of the rotating shaft such that it intersects an extension of the axis of the rotating shaft at a point above its eccentric section, whereby the separating vessels are inclined relative to a horizon so that they are rotationally oscillated around the points of intersection between the extensions of the axes of the eccentric sections and the axis of the rotating shaft as phantom fulcrums, as the rotating shaft is rotated.

6 Claims, 15 Drawing Sheets

ROTATIONALLY OSCILLATING SEPARATOR WITH ECCENTRIC SHAFT MOUNTING PORTIONS

BACKGROUND OF THE INVENTION

This invention relates to a separator for separating mixed rice into unhulled rice and unpolished rice after the rice have passed through a rice huller to remove the hulls from rice, and more particularly, to a separator of a type of rotationally oscillating a separating vessel having segmental separating plates for such separation.

Japanese patent application Heisei 10-51482 filed by the same assignee as in the present application, discloses this type of rotationally oscillating separator comprising a separating vessel suspended by means of a plurality of stays extending radially downwardly from their apex defining a fulcrum at the top of a stationary support frame,and having a plurality of segmental separating plates disposed in a cone-shaped configuration within the vessel, a vertical shaft positioned below the support frame and having an eccentric portion coupled to the bottom of the vessel via an universal joint, and drive means for rotatively driving the shaft. During operation of the separator, rotation of the shaft causes the separating vessel to be eccentrically rotated about the fulcrum, thereby rotationally oscillating the separating plates for separation of mixed rice into the unhulled rice and the unpolished rice. In this arrangement, there are disadvantages of increasing a height of the machine and a space where the machine is installed due to the fact that the separating vessel is suspended by the plurality of stays. The presence of fulcrum makes it difficult to install the separating vessels in a stacked relation.

SUMMARY OF THE INVENTION

An object of the invention is to provide a rotationally oscillating separator of being capable of rotationally oscillating separating vessels disposed at multiple steps, simultaneously, without any increase in height of the machine and installation space for the machine.

An other object of the invention is to provide a rotationally oscillating separator of this type that the unhulled rice and unpolished rice are separated from each other on separating plates within the separating vessels so that the unhulled rice can be efficiently discharged through the separating vessel.

A further object of the invention is to provide a rotationally oscillating separator of this type that a layer of mixed rice on the separating plates can be maintained at a substantially constant thickness.

The above-mentioned object can be achieved in accordance with the invention, by providing a rotationally oscillating separator comprising a vertical rotating shaft supported for rotation and having an axis, means for rotatively driving the rotating shaft, said rotating shaft including eccentric sections offset from the axis of the rotating shaft, separating vessels rotatably mounted on the eccentric sections and having a plurality of segmental separating plates disposed in a cone-shaped configuration within the separating vessels, retaining means on the separating vessels for preventing them from freely rotating, each of the eccentric sections having its axis, an upward extension of which is at a slight angle to the axis of the rotating shaft such that it intersects an extension of the axis of the rotating shaft at a point above its eccentric section, whereby the separating vessels are inclined relative to a horizon so that they are rotationally oscillated around the points of intersection between the extensions of the axes of the eccentric sections and the axis of the rotating shaft as phantom fulcrums, as the rotating shaft is rotated.

According to the invention, each of the eccentric sections includes eccentric upper and lower portions on which the separating vessels are rotatably mounted. In an alternative embodiment, each of the eccentric sections is defined by a smaller diameter eccentric cam and a larger diameter eccentric cam fixed to a straight rotating shaft at a slight inclination relative to a horizon and defining eccentric upper and lower portions.

In a preferred embodiment of the invention, the separator further includes an annular weir positioned on the segmental separating plates at the center of each of the separating vessels and having an opening for discharging unhulled rice, a shutter on the weir for opening and closing the opening in the weir, and means for operating the shutter. The latter means is actuated in response to output signals from a sensor for sensing unhulled rice and unpolished rice in the mixed rice on the separating plates.

In a further preferred embodiment of the invention, the separator includes means for adjusting an angle of inclination of the segmental separating plates within the separating vessels. There is provided a level sensor for sensing the thickness of the layer of mixed rice on the separating plates. When the level sensor senses deviation of the layer from a predetermined thickness, the adjusting means is operated to adjust the angle of inclination of the separating plates sharply or gently.

BRIEF DESCRIPTION OF THE DRAWINGS

For more complete understanding of the invention, and additional features and other advantages thereof, reference may be made to the following detailed description taken in conjunction with the accompanying drawings.

PREFERRED EMBODIMENTS OF THE INVENTION

Figure 1:
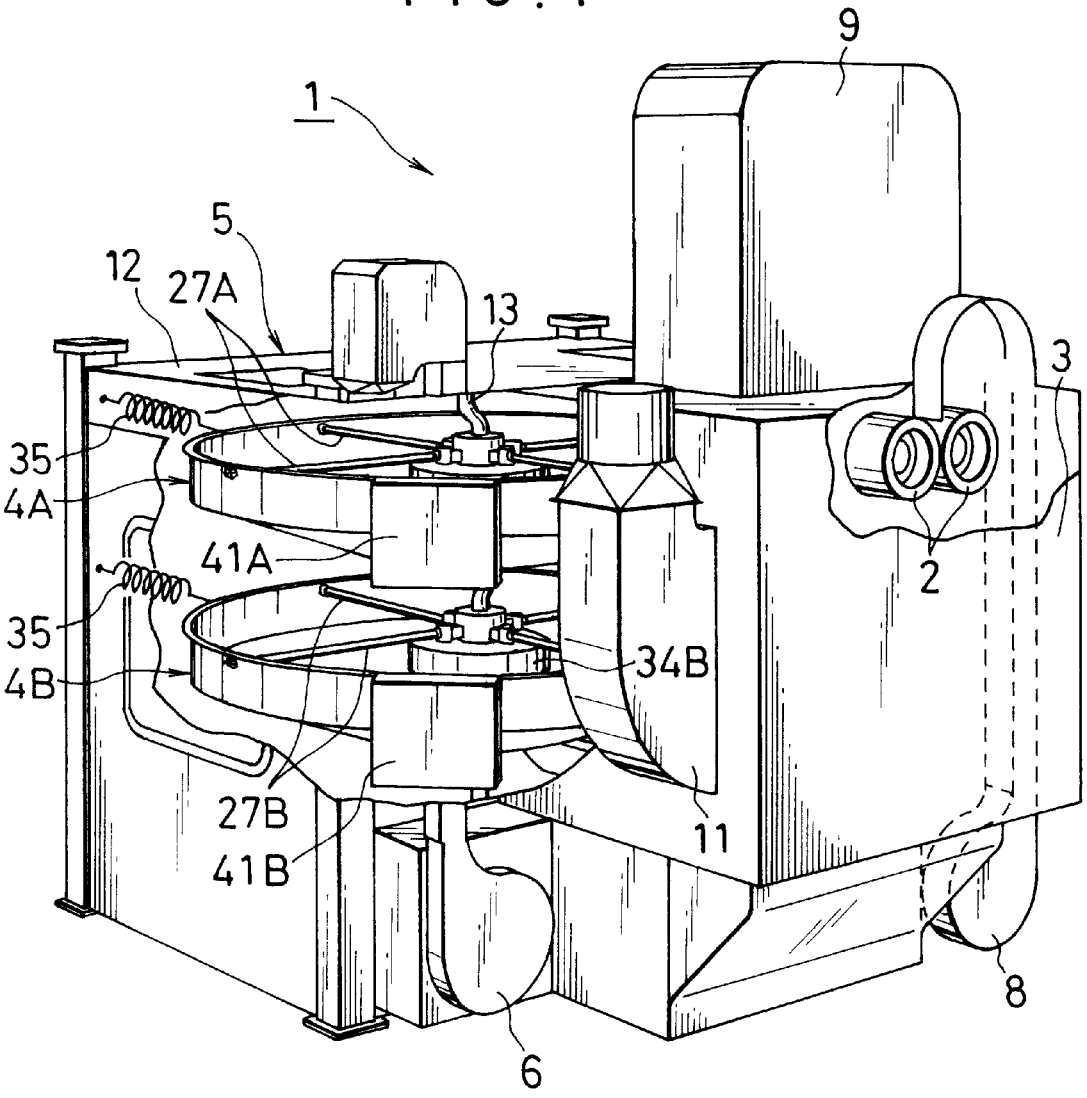
FIG. 1 is a perspective view of a rice huller with a rotationally oscillating separator according to the invention, showing part of it cut away.
Figure 2:
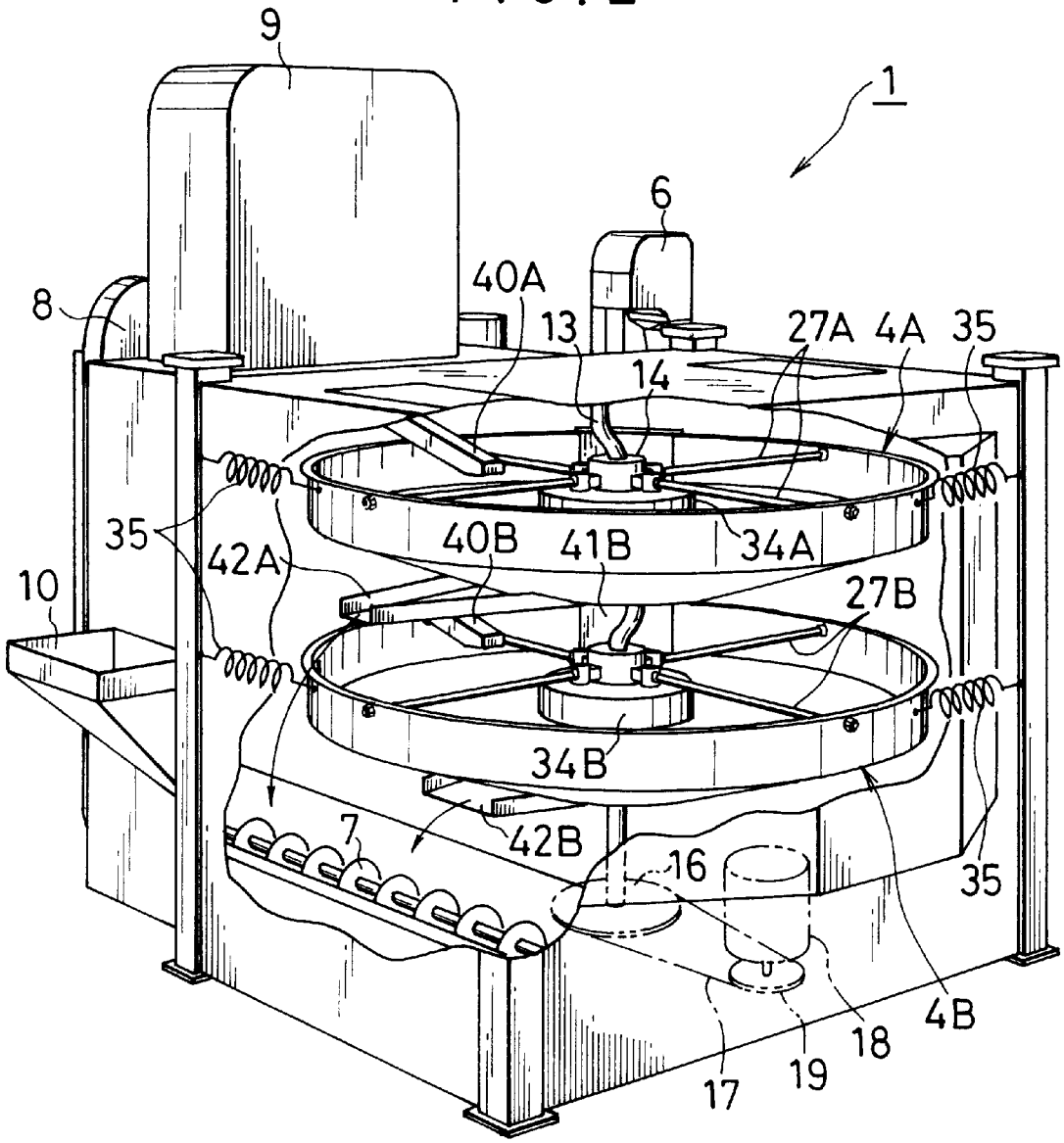
FIG. 2 is a view similar to FIG. 1, but showing a side opposite to that of FIG. 1.

Referring to FIGS. 1 through 4 of the drawings, a huller and separator unit 1 comprises a rice huller 3 including a pair of hulling rolls 2 and 2 by which rice are hulled, a rotationally oscillating separator 5 for separating the rice passing through the rice huller 3, into the unhulled rice and the unpolished rice, a thrower 6 for discharging the separated unpolished rice into exterior of the machine, a screw conveyor 7 for returning the unhulled rice to the rice huller 3, and a thrower 8 for supplying unhulled rice from its source into the rice huller 3. Reference numeral 9 indicates a reservoir for storage of the mixed rice consisting the unhulled rice and the unpolished rice, and reference numeral 10 a hopper into which the unhulled rice are fed, and reference numeral 11 a casing for a winnower for winnowing the hulls from the rice hulled by the rice huller 3.

Figure 3:
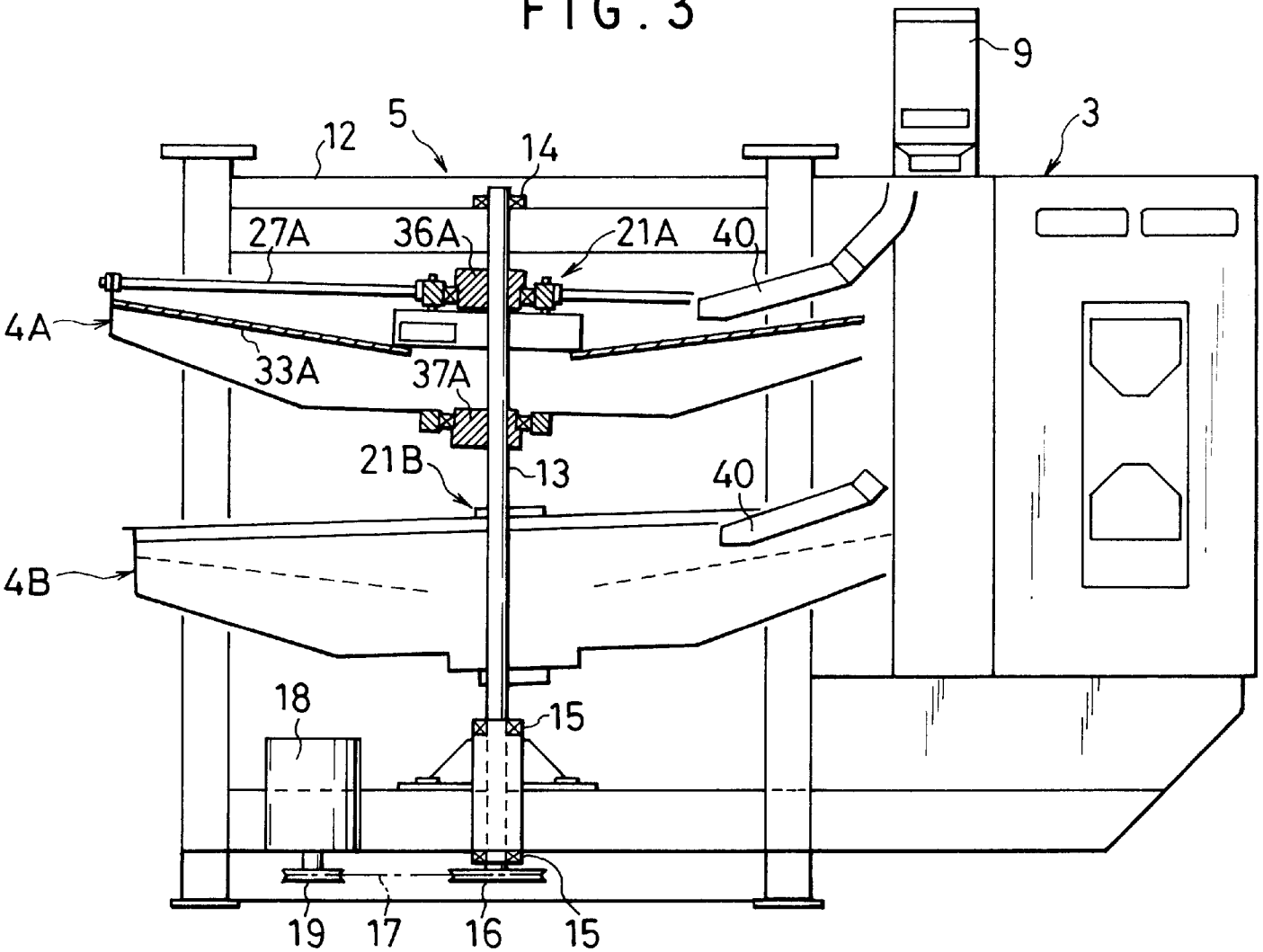
FIG. 3 is a schematic vertical cross-sectional view of the rice huller with the rotationally oscillating separator according to the invention, showing a drive therefor.
Figure 4:
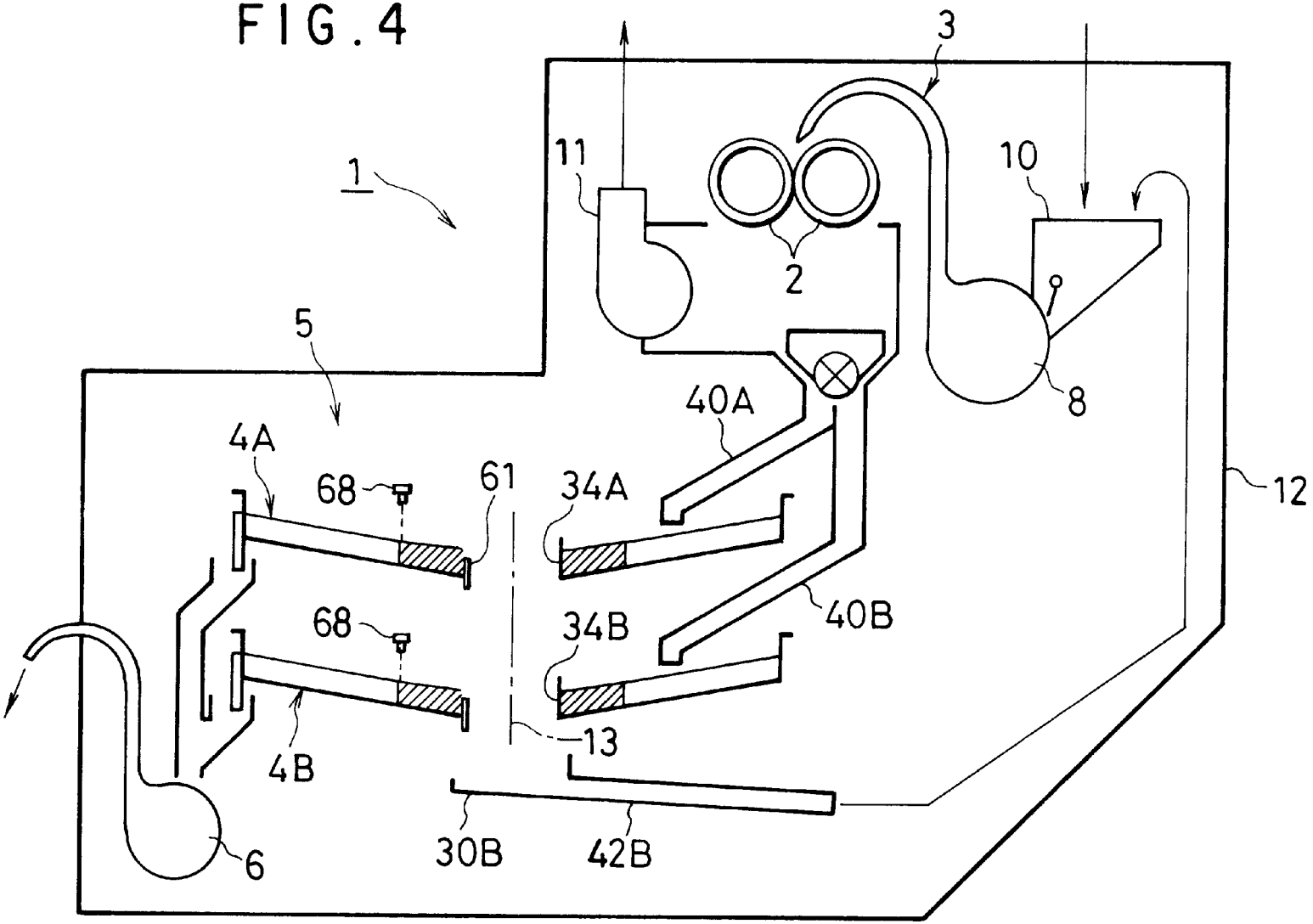
FIG. 4 is a schematic view of the rice huller with the separator.

Referring to FIG. 3, there is illustrated details of the rotationally oscillating separator 5 comprising a rotating shaft 13 positioned centrally of a machine frame 12, two separating vessels 4A and 4B mounted on the rotating shaft 13 in a stacked relation. The rotating shaft 13 is rotatably supported at its upper end in bearings 14 mounted at the top of the machine frame 12 and at its lower end in bearings 15 mounted at the bottom of the machine frame 12. A pulley 16 is fixed to the rotating shaft 13 at its lower end and connected through a belt 17 to a pulley 19 of a electric motor 18, which is energized to rotatively drive the rotating shaft 13 at predetermind number of revolutions.

Figure 5:
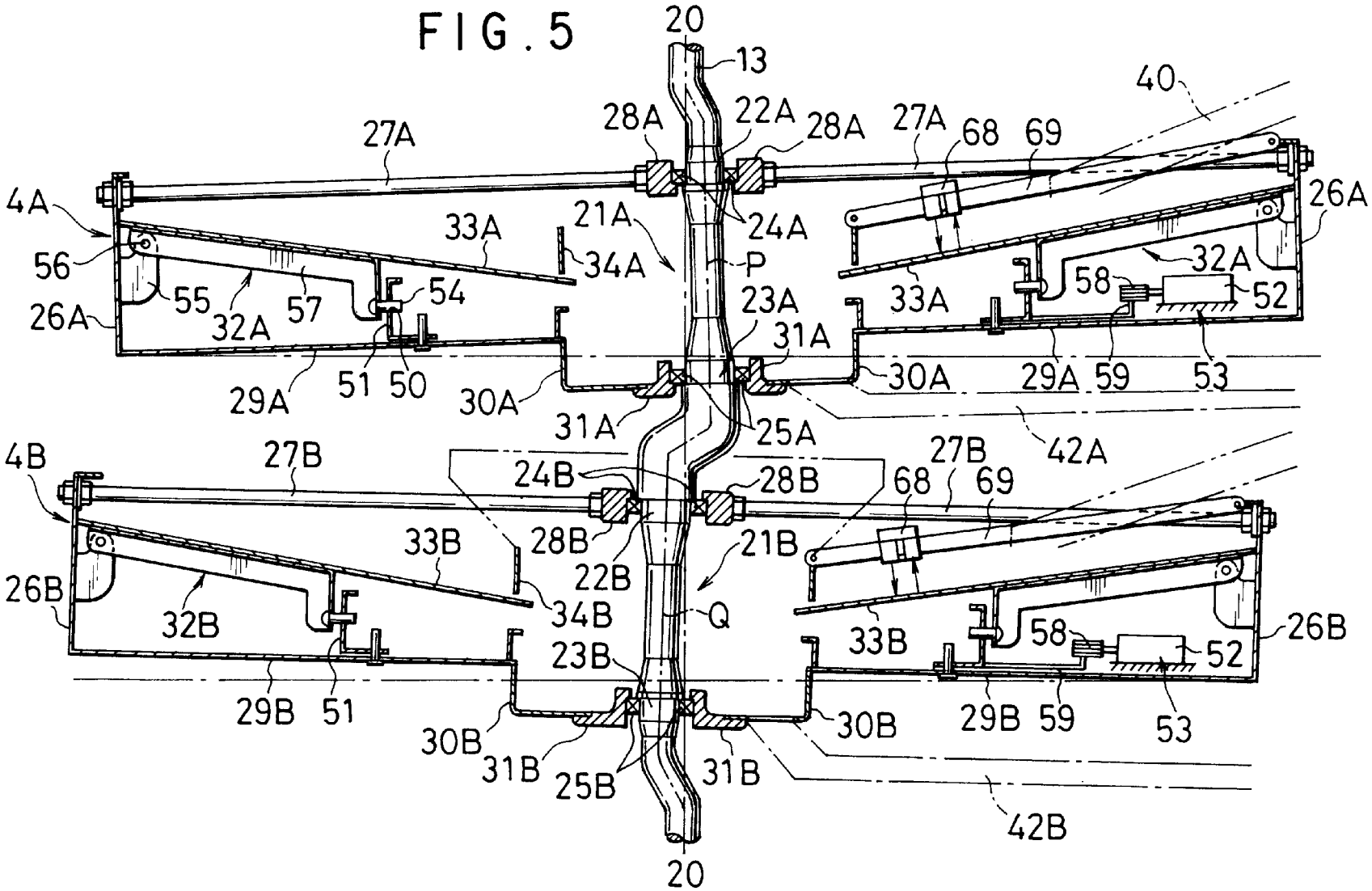
FIG. 5 is a vertical cross-sectional view of the rotationally oscillating separator according to the invention.

Referring FIG. 5, the rotating shaft 13 is provided with eccentric sections 21A and 21B offset from an axis 20 thereof and spaced apart from each other through an angle of 180 degree so that the separating vessels 4A and 4B are rotatably mounted on the eccentric sections in a balanced relation. The eccentric sections 21A and 21B have their axes P and Q, respectively, extending obliquely upwardly at a slight angle to the axis 20 of the rotating shaft 13 such that the extension of each of the axes P and Q intersects the axis 20 of the rotating shaft 13 at a point above the eccentric section 21A or 21B. Therefore, each of the eccentric sections progressively increases in eccentricity from its top toward the bottom. More particularly, each of lower eccentric portions 23A and 23B of the eccentric sections has larger eccentricity than that of each of upper eccentric portions 22A and 22B of the eccentric sections so that when the separating vessels 4A and 4B are rotatably mounted on the eccentric sections, they are slightly inclined relative to a horizon.

Figure 6:
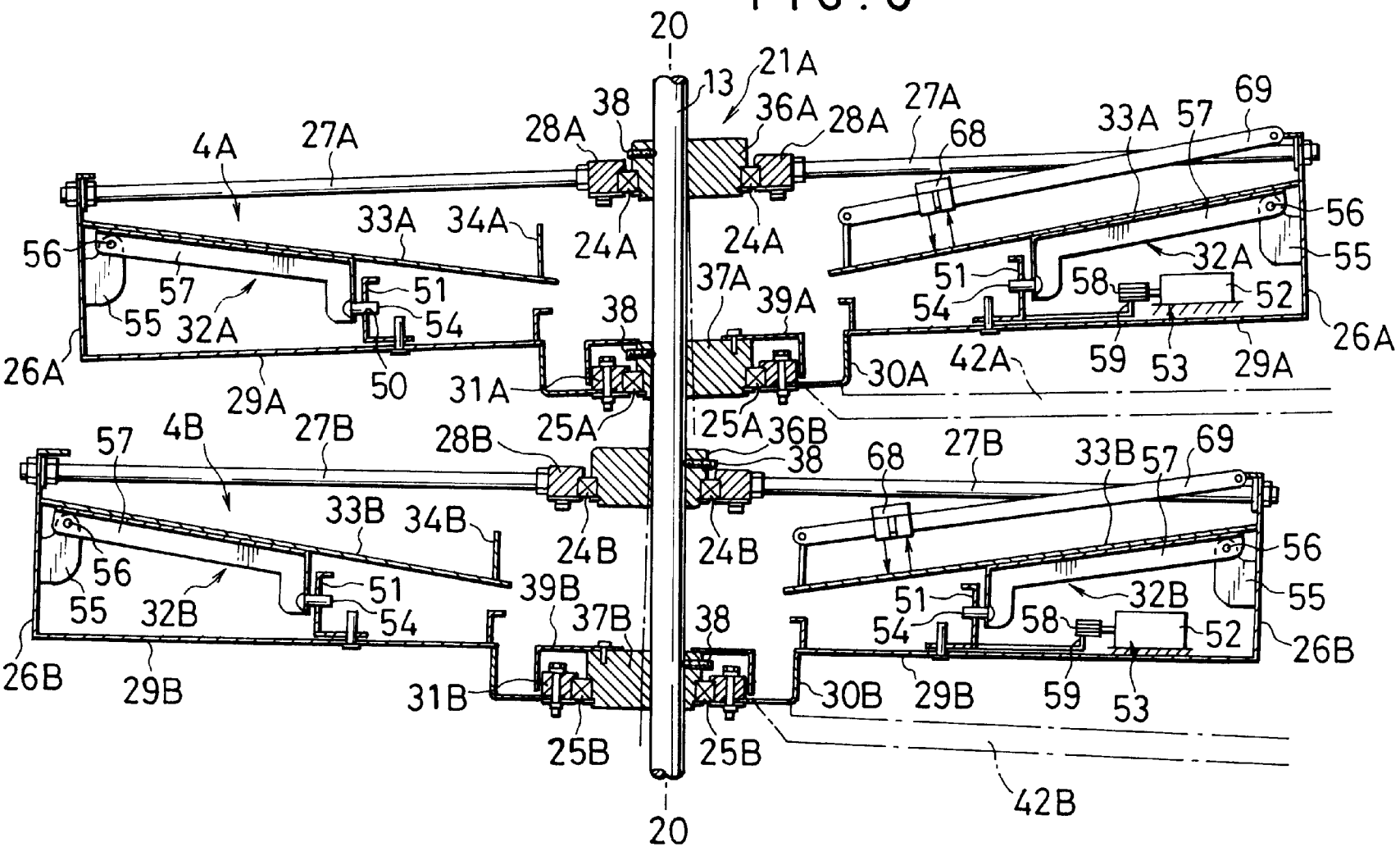
FIG. 6 is a view similar to FIG. 5, showing an alternative embodiment of the rotationally oscillating separator according to the invention.

The separating vessels 4A and 4B have side walls 26A and 26B at the periphery thereof and are formed at their bottoms 29A and 29B with pits 30A and 30B for receiving unhulled rice, respectively, to which troughs 42A and 42B as shown in dotted lines, are connected. Mounting of the separating vessels 4A and 4B to the eccentric sections, is accomplished by first hub members 28A and 28 mounted on the upper eccentric portions 22A and 22B via bearings 24A and 24B and supported from the side walls 26A and 26B by means of a plurality of tie rods 27A and 27B fixed at their one ends to the side walls 26A and 26B, and at the bottom thereof, by second hub members 31A and 31B mounted on the lower eccentric portions 23A and 23B via bearings 25A and 25B and fixed to the bottoms of the pits 30A and 30B. Referring to FIG. 6, a rotationally oscillating separator 5 shown herein, is substantially identical to that shown in FIG. 5 with the exception of the arrangement of the rotating shaft 13. In this embodiment, eccentric sections 21A and 21 B are defined by small diameter eccentric cams 36A and 36B and large diameter eccentric cams 37A and 37B fixed, respectively, by means of set screws 38 to a straight rotating shaft 13 at a slight inclination relative to a horizon. First hub members 28A and 28B are supported from the side walls 26A and 26B by means of a plurality of tie rods 27A and 27B fixed at their one end to the side walls 26A and 26B and mounted on the small diameter eccentric cams 36A and 36B via bearings 22A and 22B, respectivelly. Second hub members 31A and 31B secured to the pits 30A and 30B are mounted on the large diameter eccentric cams 37A and 37B via bearings 25A and 25B, respectively The eccentric cams 36A, 37A and 36B, 37B have orientations reversed through 180 degree and therefore, the separating vessels 4A and 4B are staggered and disposed on the rotating shaft at a slight inclination relative to the horizon. Reference numerals 39A and 39B indicate dust covers for preventing any dust from entering the eccentric cams 37A and 37B and the bearings 25A and 25B, the dust covers 39A and 39 B being fixed to the eccentric cams 37A and 37B to rotate together with them.

Figure 7:
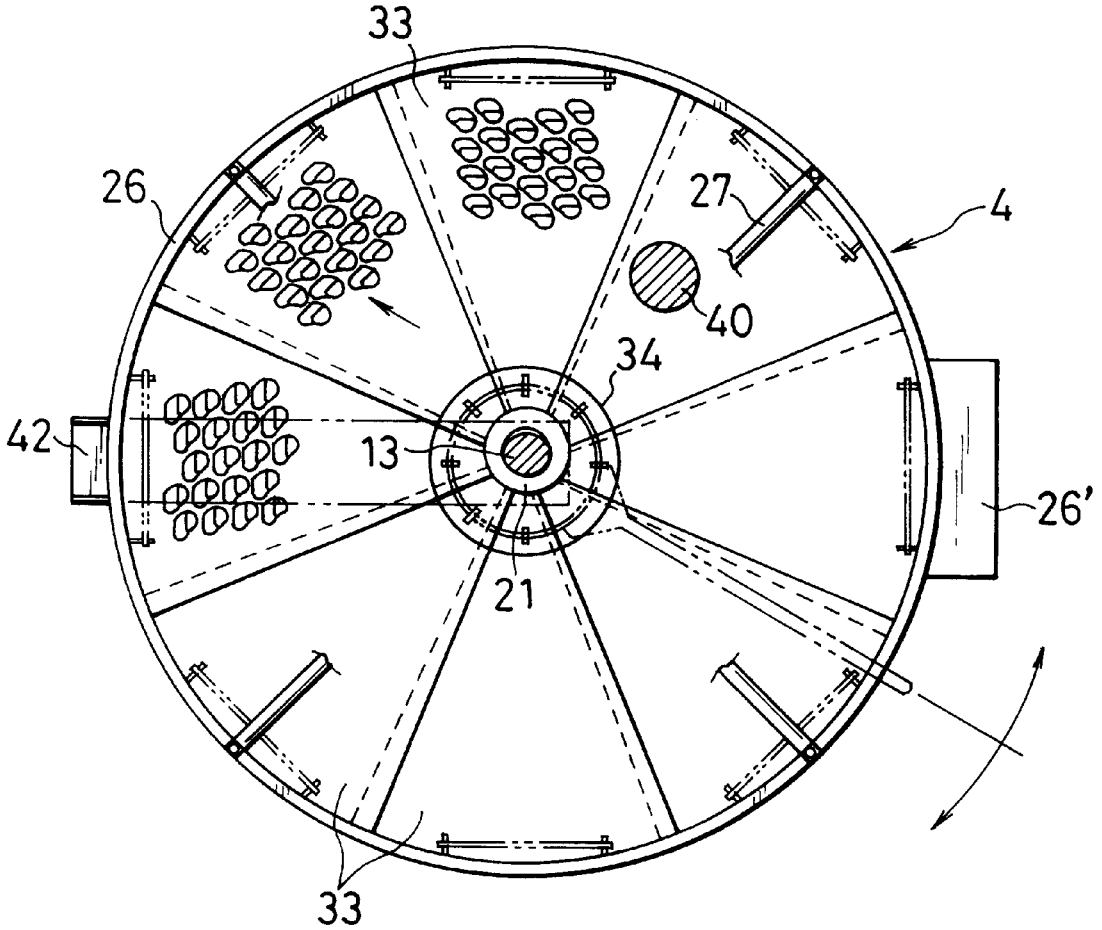
FIG. 7 is a schematic top plan view of a separating vessel.
Figure 8:
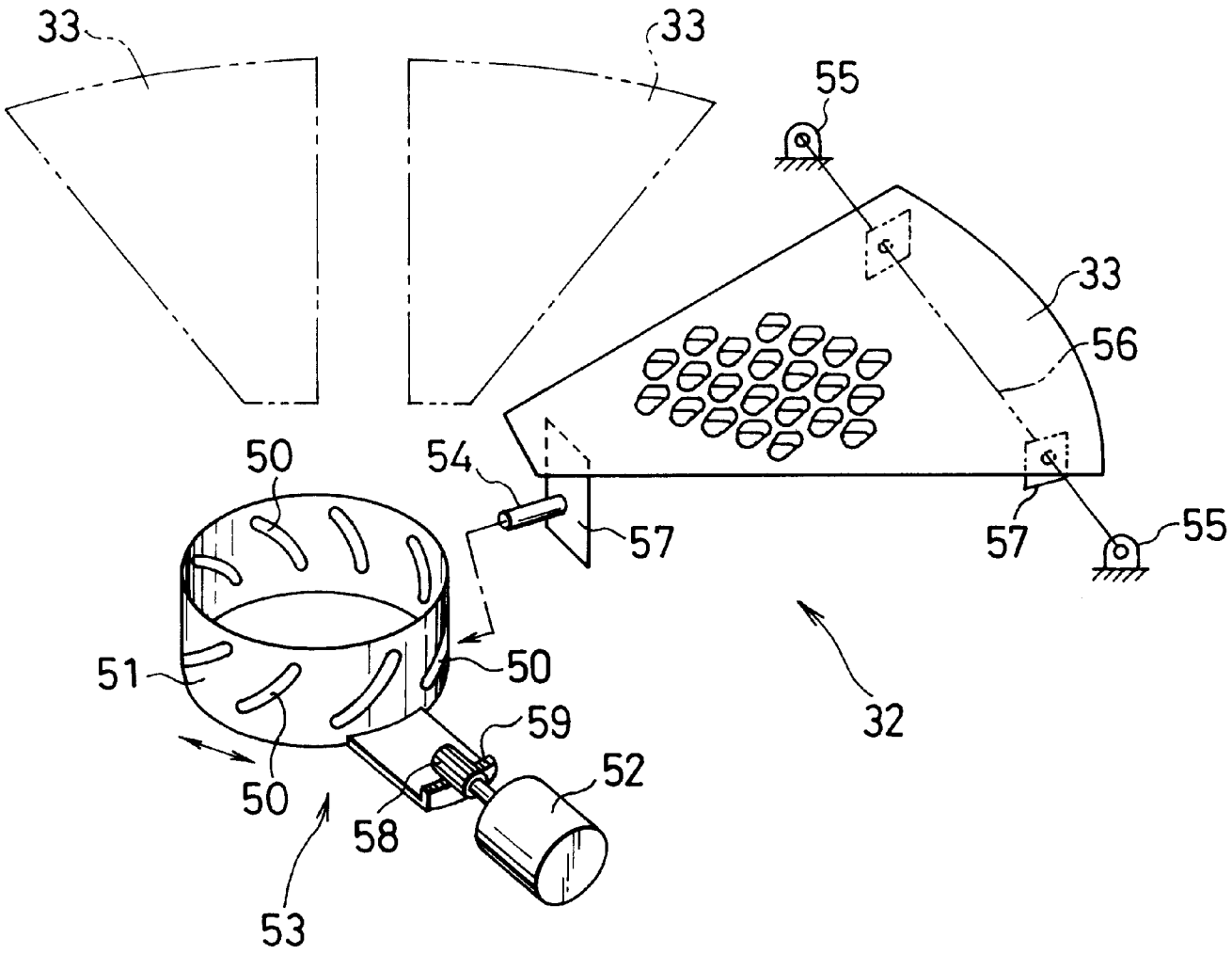
FIG. 8 is a perspective view of a mechanism for adjusting an angle of inclination of separating plates within the separating vessel.

As can be seen in FIGS. 5 through 7, a plurality of segmental separating plates 33A and 33B are disposed in a cone-shaped configuration within the separating vessels 4A and 4B. The adjacent separating plates are overlapped at their edges Provided below the separating plates within the separating vessels are means 32A and 32B for adjusting angle of inclination of the separating plates 33A and 33B. The adjusting means includes a cylindrical cam 51 mounted on the bottom 29A or 29B of each of the separating vessels for rotation through a predetermined angle and having a plurality of inclined cam slots 50, drive means 53 which may be a reversible electric motor 52 adapted to rotate the cylindrical cam 51, and support frames 57 having at their one ends pins 54 engaged in the cam slots 50 in the cylindrical cam 51 and pivoted at their other ends to a bracket 55 secured to the side wall 26A or 26B of the separating vessel 4A or 4B, by means of a pivot pin 56. The support frames 57 also serve to support the separating plates 33A or 33B from below. As can best be seen in FIG. 8, the drive means 53 includes a pinion 58 on an output shaft of the reversible electric motor 52, and a sector rack 59 provided on the cylindrical cam 51 and meshed with the pinion 58 to transmit rotation of the electric motor to the cylindrical cam 51. Rotation of the cylindrical cam 51 causes the pins 54 to be guided along the inclined cam slots 50, thereby pivoting the separating plates 33A or 33B about the pivotal connection 56. Thus, the inclination of the separating plates 33A and 33B can be adjusted at any suitable angle between 8 degree and 12 degree. Each of the separating plates 33A and 33B may have a number of radially oriented recesses formed on the surface thereof to aid separation of the unhulled rice and unpolished rice from each other during oscillation, which takes place due to difference between their particle sizes and difference between their specific gravity. As can best be seen in FIGS. 1 and 2, a plurality of coil springs 35 are connected between the side walls 26A and 26B of the separating vessels 4A and 4B and the machine frame 12 to prevent the separating vessels 4A and 4B from freely rotating during their operation.

Figure 9:
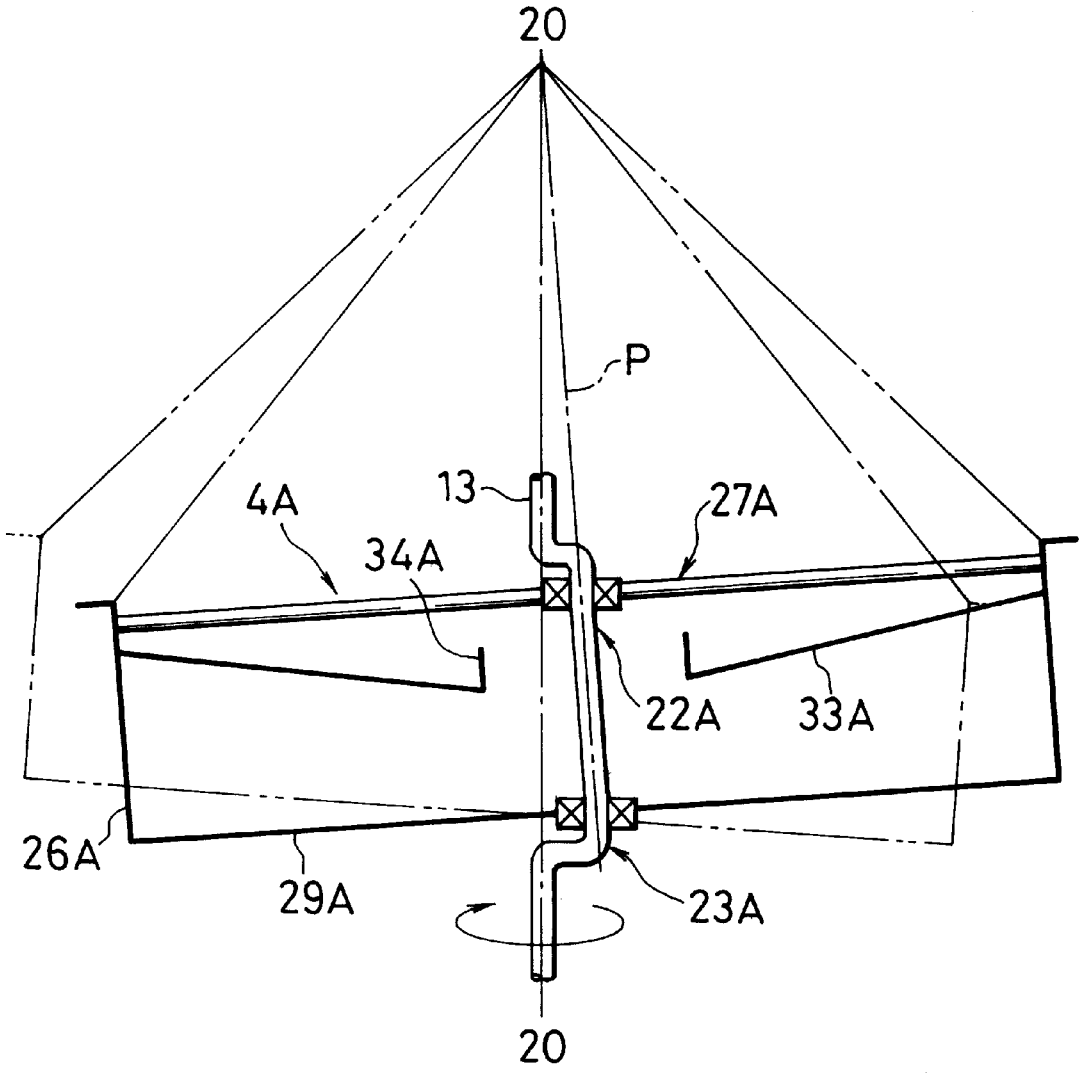
FIG. 9 is schematic view of the separating vessel, showing a principle of rotational oscillation thereof.

Referring to FIG. 9, there is illustrated a principle of operation of the upper separating vessel 4A of the rotationally oscillating separator in the first embodiment of the invention. As the shaft 13 is rotated in a direction as indicated by an arrow, the separating vessel 4A is rotationally oscillated between a solid line position and a dotted line position around a point of intersection 20 of the extension of the axis Q of the eccentric section 21A with the extension of the axis P of the rotating shaft 13, defining a phantom fulcrum. It will be apparent that the separating vessel 4B performs the identical motion. By rotatably mounting the separating vessels on the eccentric sections having their axes inclined relative to the axis of the rotating shaft, the separating vessels can be stacked without any significant increase in height of the machine.

During operation of the huller with separator 1, the mixed rice consisting of unhulled rice and unpolished rice, is supplied from its reservoir 9 through a supply trough 40 into the rotationally oscillating separating vessels 4A and 4B. Since the mixed lice on the segmental plates in the cone-shaped. configuration within the separating vessels are subject to increased peripheral speed in the vicinity of the side walls 26A and 26B and the segmental separating plates 33A and 33B are inclined relative to the horizon, the unpolished rice having smaller particle size and greater specific gravity are conveyed on the separating plates toward the side walls 26A and 26B under the centrifugal force while the unhulled rice having larger particle size and lower specific gravity slid on the separating plates 33A and 33B toward the centers of the separating vessels. The unpolished rice are discharged through an opening 26' (see FIG. 7) in each of the side walls 26A and 26B via a discharge duct 41A or 41B and a discharge thrower 6 to the exterior of the machine. The unhulled rice are moved toward the opening 60 in each of the annular weirs 34A and 34B while being blocked by it. Thus, the unhulled rice are dropped through the opening 60 into the pit 30A or 30B from which they are delivered through the discharge trough 42A or 42B onto the screw conveyer 7 to return the unhulled rice to the huller 3 for further hulling of them. The unpolished rice discharge opening 26' and the unhulled rice discharge opening 60 are preferably spaced apart from each other through 180 degree. Each of the mixed rice supply troughs 40 is preferably disposed on a radial line at a location spaced through 45 degree from the center of the unhulled rice discharge opening in a direction that the mixed rice are conveyed on the separating plates.

Figure 10:
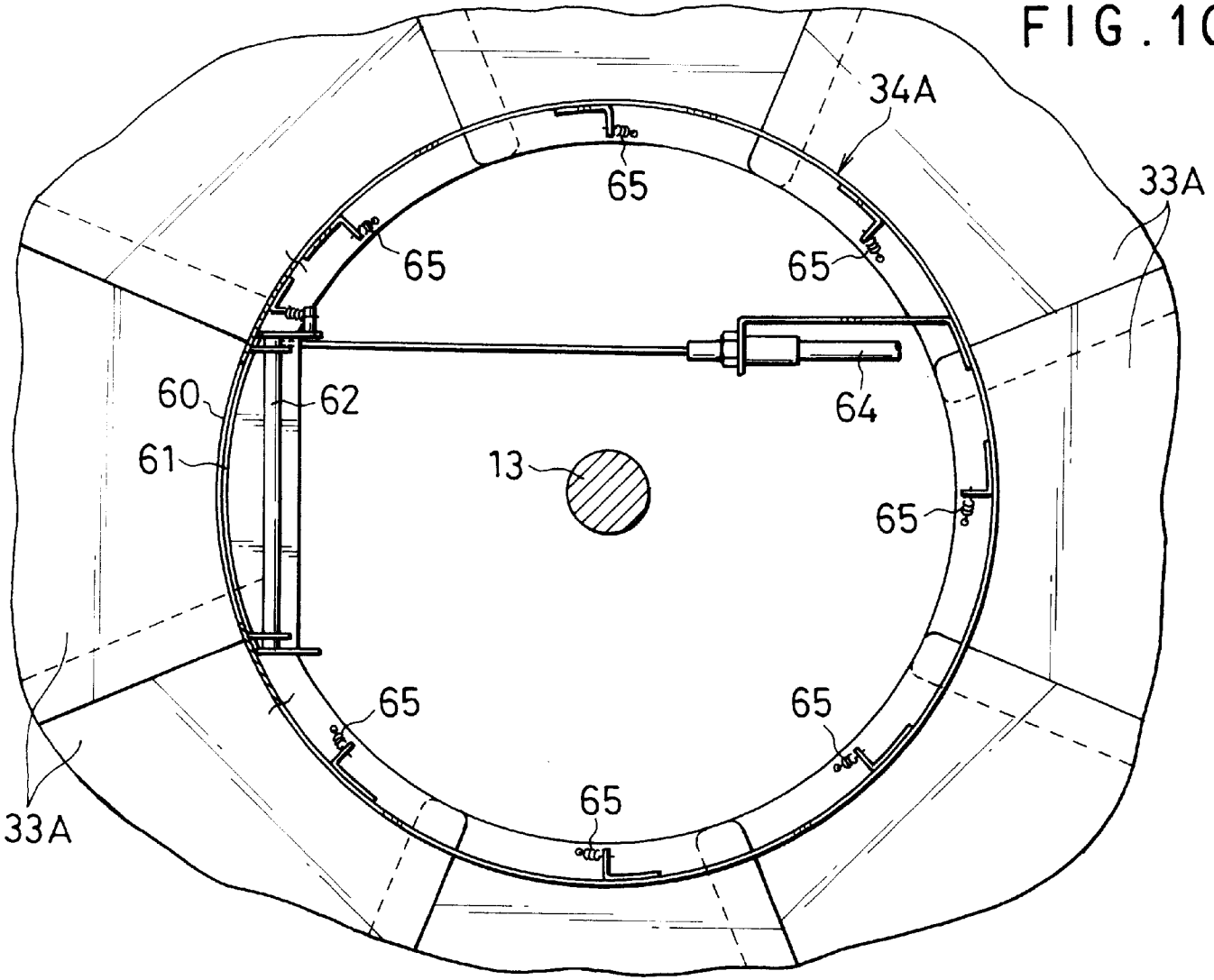
FIG. 10 is a top plan view of a weir positioned on the separating plates.
Figure 11:
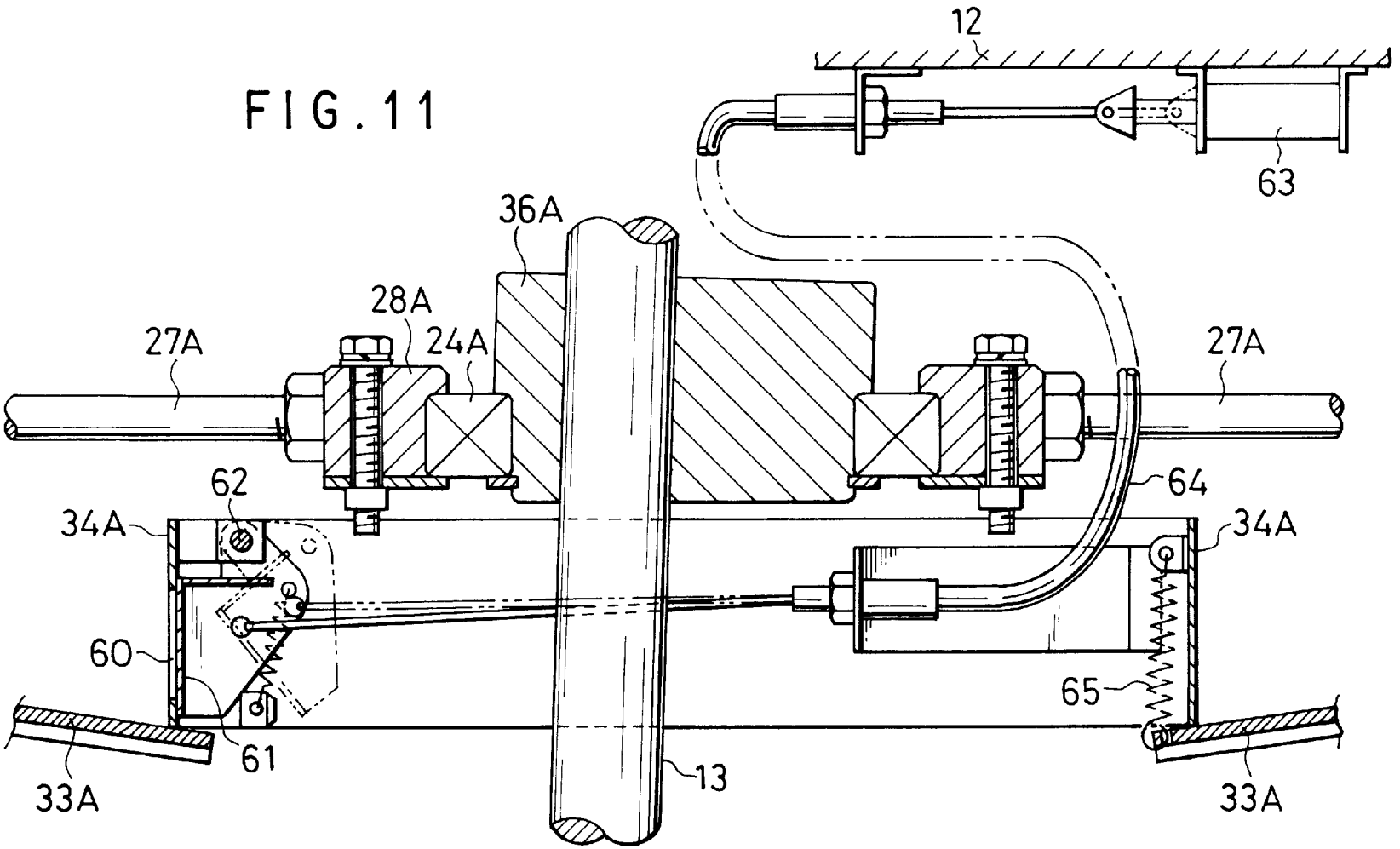
FIG. 11 is a vertical cross-section of FIG. 10.

Referring to FIGS. 10 and 11, there is illustrated in detail a relationship between the separating plates 33A of the separating vessel 4A and the annular weir 34A. The annular weir 34A rests on the separating plates 33A and a plurality of coil springs 65 are connected between the annular weir 34A and the separating plates 33A so that the weir 34A is moved up and down in response to the adjustment of the angle of inclination to prevent any gap which might be formed between the separating plates and the weir. A shutter 61 is pivoted to the weir 34A by means of an axle 62 to open and close the unhulled rice discharge opening 60. An actuator such as a solenoid 63 is fixed to the machine frame and connected through a cable 64 to the shutter 61. The solenoid 63 is energized to operate the shutter 61, thereby closing the opening 60. It will be understood that although the solenoid has been illustrated and described as actuator, a pneumatic cylinder may be employed. Although the description has been made with respect to the separating vessel 4A, it will be apparent that the same arrangement is applied to the separating vessel 4B with respect to the annular weir 34B.

Figure 12:
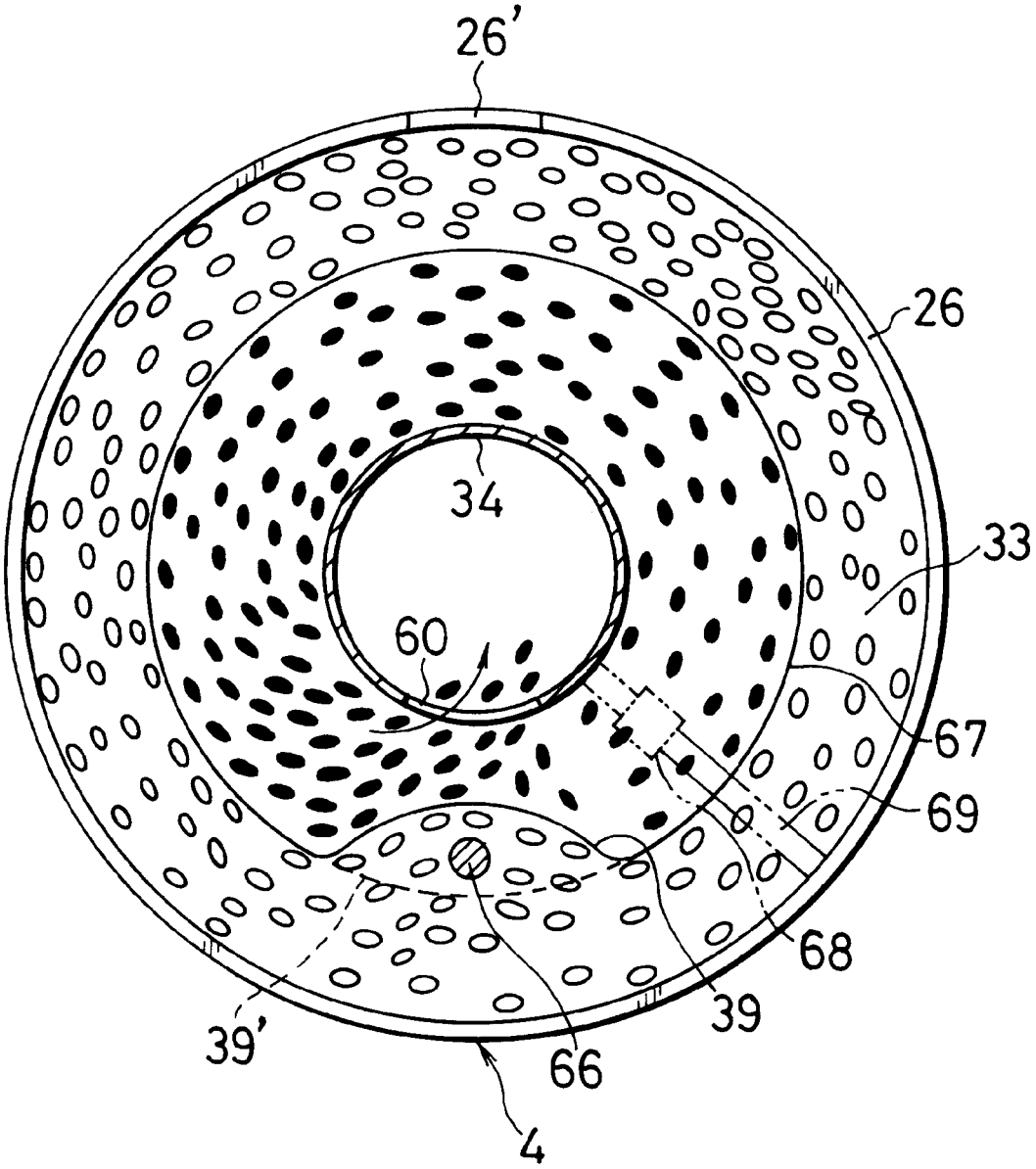
FIG. 12 is a top plan view of the separating vessel having a unhulled rice and unpolished rice sensor and a level sensor positioned above the separating plates.

Referring to FIG. 12, there are provided sensors 66 above the segmental separating plates 33A and 33B of the separating vessels. Light is applied to the unhulled and unpolished rice to reflect it from them. The sensor 66 functions to discriminate between the unhulled rice and the unpolished rice on the separating plates, by receiving reflected lights from them, which are different in intensity. Thus, the sensor can sense a boundary between the area of unhulled rice and the area of unpolished rice on the separating plates. The sensor 66 is positioned such that it is on a radial line from the center of the separating vessel through the opening 60 and slightly inside of the boundary between the area of the unhulled rice and the area of the unpolished rice.

When enough time to make thickness of the mixed rice stable has passed after commencing operation of separation, the boundary as indicated by reference numeral 67 in FIG. 12 is clearly established between the area of the unhulled rice and the area of the unpolished rice. At this point, the sensor 66 senses the unhulled rice to provide "on" signal. The actuator 63 is energized via a timer (not shown) set at any suitable time between 0.5 second and 1.5 second, for example, in response to the signal from the sensor to operate the shutter 61, thereby opening the opening 60. The unhulled rice are rapidly discharged through the opening 60 into the pit 30A or 30B so that a portion of the boundary 67 in FIG. 12 will be formed into a concavity toward the opening 60. When the preset time of the timer is up, the solenoid 63 is deenergized to operate the shutter 61, thereby closing the opening 60. Again, the thickness of the layer of unhulled rice increases and the boundary returns from the state as indicated by 39 to the original state as indicated by 39' in several seconds. When the sensor again senses the layer of unhulled rice, the same operation of the shutter 61 will be repeated. When the area of the unhulled lice is thus moved to the predetermined position, the blocked unhulled rice is discharged through the opening in the weir, and when the area of the unhulled rice is returned from the position, the discharge of the unhulled rice is stopped. In this way, during the period of operation of separation from its commencement, the amount of discharge of unhulled rice is controlled by a ratio of unhulled rice layer to unpolished lice on the separating plated in the cone-shaped configuration. Of course, the solenoid may be energized via a manual switch (not shown) to operate the shutter, thereby opening the unhulled rich discharge opening 60.

If in operation of separation, physical properties such as moisture of the mixed rice, its friction coefficient or the like do not change, the ability to separate the mixed rice into unhulled and unpolished rice will not change. If the mixed rice to be separated into unhulled and unpolished rice, however, have different physical properties, the thickness of the layer of mixed rice on the separating plates will change and as a result, the ability of separation will change. According to the invention, an angle of inclination of the separating plates of the separating vessels is adjusted in response to variation of the thickness of the mixed rice layer without varying a quantity of supply of the mixed rice and the number of revolutions to maintain the mixed rice layer at a proper thickness.

Referring to FIG. 12, there is further provided a sensor 68 for sensing the thickness of the mixed rice on each of the separating plates 33A and 33B. The sensor 68 is positioned downstream of the unhulled rice discharge opening 60 adjacent the weir 34A, 34B, to avoid any influence of discharge of the unhulled rice through the opening 60 and to sense an area of layer of unhulled rice having its stable thickness. As can be seen in FIGS. 5 and 6, the sensor 68 is mounted on a linkage 69 disposed parallel to the separating plates 33A or 33B. The sensor 68 may be a distance-setting type photoelectric switch(Model ES3-L manufactured by OMURON Co. Ltd.) or may be an analog-output type photo-electric sensor.

Figure 13:
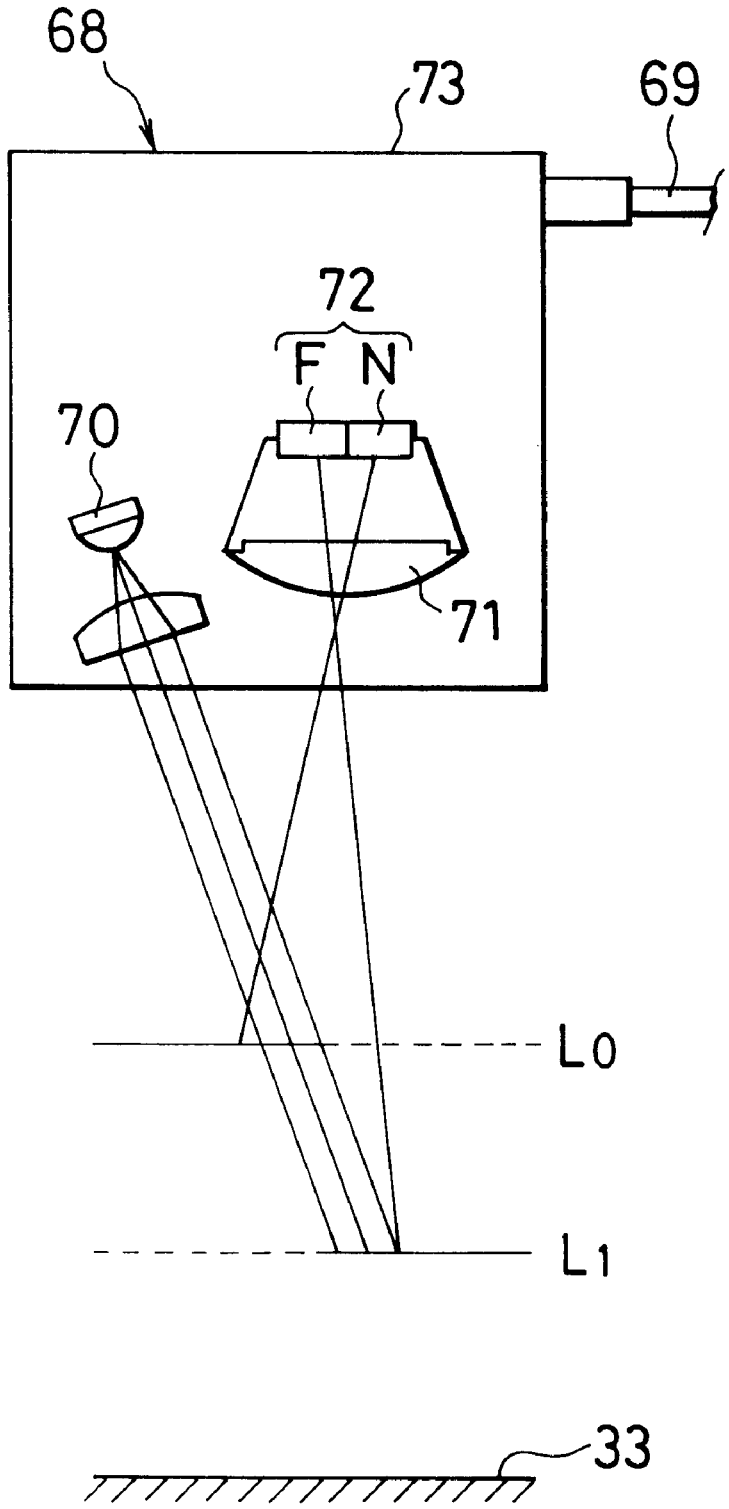
FIG. 13 is a view of the level sensor, showing its functions of sensing thickness of a layer of mixed rice.

FIG. 13 illustrates the distance-setting type photo-electric sensor 68 for sensing the thickness of layers. This sensor 68 comprises a light projector 70 for projecting parallel light toward an area being sensed, a collective lens 71 for collecting reflecting light from objects to be sensed, and a photoelectric receiver 72 disposed behind the collecting lens 70 and including a photodiode N adapted to receive nearer light and a photodiode F adapted to receive further light, these elements being housed in a casing 73. The sensor 68 can monitor a predetermined distance from a level of an upper limit L0 of the mixed rice on the separating plates (for example, the distance from the separating plates 33 being 15 mm) to the photodiode N and a predetermined distance from a level of a lower limit L1 of the mixed rice on the separating plates (for example, the distance from the separating plates 33 being 10 mm) to the photodiode F. Thus, a proper thickness of the mixed rice is between the levels L0 and L1. The reversible electric motor 52 n is energized or deenergized under the "on" or "off" action of the photodiodes N and F.

When the thickness of the layer of mixed rice increases to L1 after commencement of operation of separation, both the photodiodes F and N are at "off" state where actuation of a normal electric circuit causes the reversible electric motor 52 to be rotatively driven in a one direction, thereby increasing the angle of inclination of the separating plates 33. When the thickness of the layer further increases from L1 to L0, the photodiode F is at "on" state while the photodiode N is at "off" state. This results in no actuation of the normal electric circuit for stoppage of the reversible electric motor 52. When the thickness of the layer is beyond L0, both the photodiodes F and N are at on" state where the actuation of a reverse circuit causes the motor 52 to be rotatively driven in an opposite direction, thereby decreasing the angle of inclination of the separating plates 33.

Figure 14:
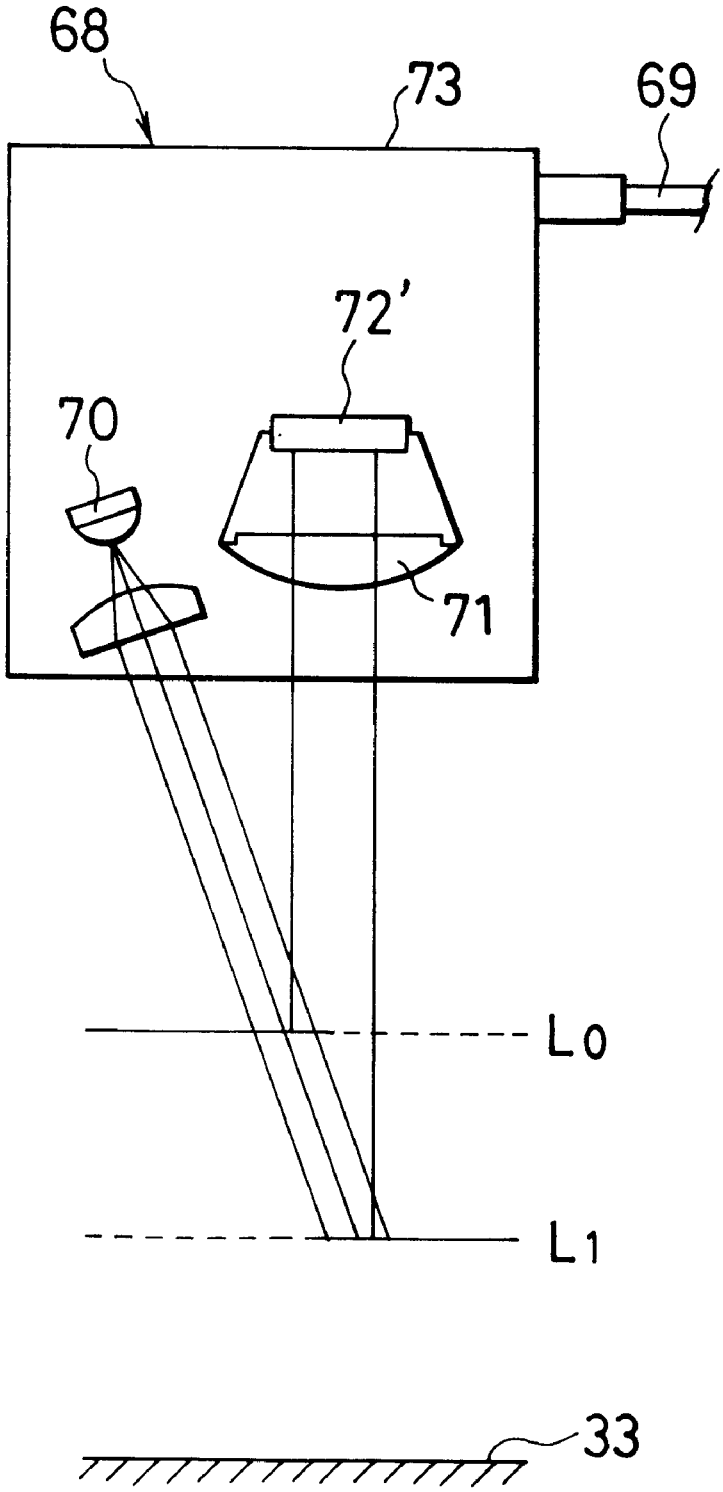
FIG. 14 is a view similar to FIG. 13, but showing a different level sensor.

FIG. 14 illustrates analog-output type photo-electric sensor. This sensor comprises a light projector 70 for projecting parallel light toward an area being sensed, a collective lens 71 for collecting reflecting light from objects to be sensed, and photoelectric receiver 72' disposed behind the collecting lens 71, these elements being housed in a casing 73. The photoelectric receiver 72' has a characteristic that a value of output (a value of electric current or voltage ) from the photoelectric receiver is proportional to monitoring distances. For this reason, values of outputs from the photoelectric receiver 72' at levels of upper and lower limits L0 and L1 of the mixed rice on the separating plates are set as threshold values. If the value of output from the photoelectric receiver is within the threshold values, the angle of inclination of the separating plates 33 is proper and therefore, the reversible electric motor 52 is not actuated. If the value of the output from the photoelectric receiver is out of the threshold values, the reversible electric motor 52 is actuated to increase or decrease the angle of inclination of the separating plates.

Figure 15:
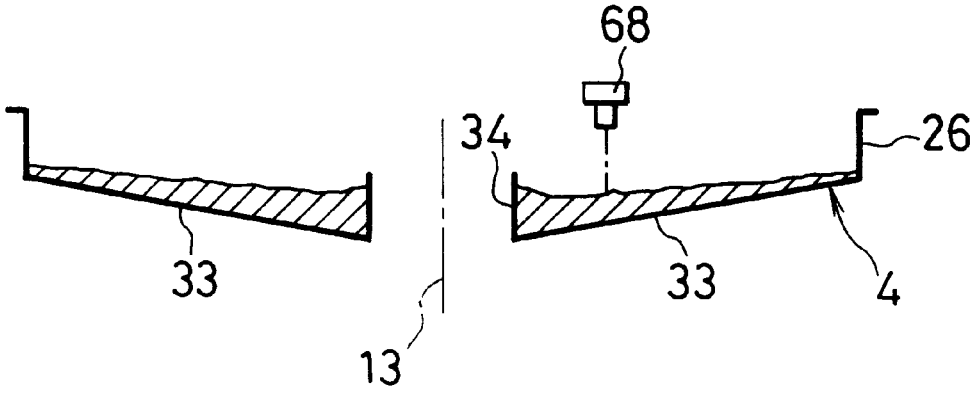
FIG. 15 is view showing a relationship between the level sensor and separation state of the mixed rice on the separating plates.

Thus, the level sensor which is disposed at a location nearer the center of the separating plates can sense the thickness of layer at that location for adjustment of the angle of inclination of the separating plates. This results in gradual decrease in the thickness of the layer of mixed rice from the center toward the periphery of the separating plates (see FIG. 15) so that the unpolished rice are unlikely to be discharged through the unhulled rice discharge opening under the centrifugal force.

What is claimed is:

1. A rotationally oscillating separator comprising a vertical rotating shaft supported for rotation and having an axis, means for rotatively driving the rotating shaft, said rotating shaft including eccentric sections offset from the axis of the rotating shaft, separating vessels rotatably mounted on the eccentric sections and having a plurality of segmental separating plates disposed in a cone-shaped configuration within the separating vessels, retaining means on the separating vessels for preventing them from freely rotating, each of the eccentric sections having its axis, an upward extension of which is at a slight angle to the axis of the rotating shaft such that it intersects an extension of the axis of the rotating shaft at a point above its eccentric section, whereby the separating vessels are inclined relative to a horizon so that they are rotationally oscillated around the points of intersection between the extensions of the axes of the eccentric sections and the axis of the rotating shaft as phantom fulcrums, as the rotating shaft is rotated.

2. A rotationally oscillating separator according to claim 1 wherein each of the eccentric sections includes upper and lower eccentric portions on which the separating vessels are rotatably mounted.

3. A rotationally oscillating separator according to claim 1 wherein each of the eccentric sections is defined by a smaller diameter eccentric cam and a larger diameter eccentric cam fixed to a straight rotating shaft at a slight inclination relative to a horizon and defining the upper and lower eccentric portions.

4. A rotationally oscillating separator accodring to claim 1 further including an annular weir positioned on the segmental separating plates at the center of each of the separating vessels and having an opening for discharging unhulled rice, a shutter on the weir for opening and closing the opening in the weir, and means for operating the shutter, the latter means being actuated in response to output signals from a sensor for sensing unhulled rice and unpolished rice in the mixed rice on the separating plates.

5. A rotationally oscillating separator according to claim 1 wherein each of the separating plates is arranged for adjustment of an angle of inclination of the segmental separating plates and there is provided means for adjusting the angle of inclination of the segmental separating plates.

6. A rotationally oscillating separator according to claim 5 wherein there is provided a level sensor for sensing the thickness of the layer of mixed rice on the separating plates, and when the level sensor senses deviation of the layer from a predetermined thickness, the adjusting means is operated to adjust the angle of inclination of the separating plates sharply or gently.

* * * * *